US006335092B1

(12) United States Patent
Takeda et al.

(10) Patent No.: US 6,335,092 B1
(45) Date of Patent: Jan. 1, 2002

(54) COMPOSITE STAPLE FIBER AND PROCESS FOR PRODUCING THE SAME

(75) Inventors: Yasuhiro Takeda; Yoshiyuki Ando; Yoshikata Ohno, all of Okayama-ken (JP)

(73) Assignee: Kuraray Co., Ltd., Kurashiki (JP)

( * ) Notice: Subject to any disclaimer, the term of this patent is extended or adjusted under 35 U.S.C. 154(b) by 0 days.

(21) Appl. No.: 09/806,474

(22) PCT Filed: Aug. 8, 2000

(86) PCT No.: PCT/JP00/05308

§ 371 Date: Apr. 9, 2001

§ 102(e) Date: Apr. 9, 2001

(87) PCT Pub. No.: WO01/11124

PCT Pub. Date: Feb. 15, 2001

(30) Foreign Application Priority Data

Aug. 9, 1999 (JP) ..... 11-224975

(51) Int. Cl.[7] ..... D02G 3/00

(52) U.S. Cl. ..... 428/359; 428/365; 442/239; 442/243

(58) Field of Search ..... 428/297, 359, 428/364, 365, 372, 373, 374; 442/168, 199, 201, 239, 243

(56) References Cited

FOREIGN PATENT DOCUMENTS

| | | |
|---|---|---|
| JP | 58-23917 | 2/1983 |
| JP | 4-308224 | 10/1992 |
| JP | 5-25762 | 2/1993 |
| JP | 5-044127 | 2/1993 |
| JP | 6-2221 | 1/1994 |

*Primary Examiner*—Merrick Dixon
(74) *Attorney, Agent, or Firm*—Oblon, Spivak, McClelland, Maier & Neustadt, P.C.

(57) ABSTRACT

A composite staple fiber, wherein a polymer component A and a polymer component B are alternately arranged in a fiber horizontal cross-section; the fiber periphery is entirely covered with the polymer component A; both the polymer component A and the polymer component A have a substantially flat shape; the lengthwise ends of the polymer component B are located 0.05 to 1.5 $\mu$m from the fiber surface; and the weight ratio of the polymer component A to the polymer component B is from 90/10 to 10/90. The composite staple fiber of the present invention is not peeled or split by a carding and a needle punching treatments, but is divided and split in the subsequent water jet entanglement, resulting in flat ultrafine fibers having a sharp-edged structure.

9 Claims, 1 Drawing Sheet

COMPOSITE STAPLE FIBER AND PROCESS FOR PRODUCING THE SAME

TECHNICAL FIELD

The present invention relates to a composite staple fiber having a cross-section in which two polymer components are alternately layered. More particularly, the present invention relates to a composite staple fiber having its outer surface covered with one of the polymer components that constitute the fiber. More specifically, the present invention relates to a composite staple fiber which does not cause peeling or splitting between layered polymer components in the carding or needle punching treatment of a non-woven fabric production, but causes cracking in the surrounding polymer in the subsequent dividing and splitting process by a water jet treatment, a buffing treatment, etc., and then causes peeling and splitting between the layered polymer components inside the fiber, thereby allowing to obtain a fiber structure composed of groups of ultrafine fibers of the polymer components.

Since a part of the surrounding polymer of the composite staple fiber is broken in the dividing and splitting process to result in the formation of ultrafine fibers having acute edges, the fiber structure exhibits a superior wiping capacity when used, for example, as a wiper. In addition, since the fiber structure contains ultrafine fibers, artificial leather, spun lace and non-woven fabric for sanitary use having soft texture and satisfactory permeability are obtained. Moreover, since composed of densely packed fibers, the fiber structure has a good water absorption by capillary action, and shows a superior dust-removing performance when used as a filter, a breathing mask, etc. Moreover, sheets made of divided and split composite staple fibers, or sheets obtained by dividing and splitting composite staple fiber sheets have their own characteristic luster due to the flat, ultrafine fibers formed by splitting.

BACKGROUND ART

Since there are limitations on the fiber fineness due to increased susceptibility to breakage during a direct spinning, ultrafine fibers having a single fiber fineness of 0.1 denier or less have been produced by a conjugate spinning method. Examples of the cross-section of the composite fibers for forming ultrafine fibers include: (1) a multi-layered cross-section or a petal-shaped cross-section in which many parts of respective two components are separately and mutually arranged in layers, and (2) an islands-in-a-sea cross-section in which one component is finely dispersed in another component. In the former composite fibers, ultrafine fibers having sharp edges and ultrafine fibers having modified cross-sections are formed by the peeling of the components, and find various applications depending on their shapes.

Such composite fibers are typically composed of Nylon 6 and polyethylene terephthalate (PET). The methods for peeling and dividing these components include (1) a method of separation by shrinking force of the Nylon component when treated with a liquid containing a chemical such as benzyl alcohol, (2) a method of separation by slightly dissolving away the PET component with an aqueous alkali solution, (3) a method of peeling by repeating wet heat treatment and drying treatment several times, (4) a method of forcible separation by physically scouring or rubbing, and (5) a combination thereof.

It is important in view of productivity to prevent the generation of fluff caused by peeling between the composite components during the fiber production process such as the drawing process. Therefore, in a combination of, for example, Nylon 6 and PET, a PET copolymerized with 5-sodium sulfoisophthalate is used to improve the adhesion between the components. Alternatively, it has been proposed to prevent the peeling during the fiber production by spinning the composite fiber at such an increased spinning speed as to make PET and Nylon to show similar shrinkage behaviors.

However, even in the case of employing the above measures against the fiber splitting, the peeling occurs between the components of the composite fiber in the carding process for producing non-woven fabrics or spun yarns from staple fibers, resulting in the problems of the splitting composite fiber and the generation of neps. In addition, when the needle punching is performed to entangle the fibers, the peeling due to damage occurs to make composite fibers resistant to entanglement, thereby resulting in the problem of failure to increase the peel strength of the non-woven fabric.

For example, Japanese Patent Application Laid-Open Nos. 4-308224 and 5-44127 propose to prevent the peeling and splitting between the components during the carding process of the subdividable composite fiber by covering the fiber surface with one of the components that compose the composite fiber.

However, these known techniques are directed to composite fibers of a type in which the surrounding of the composite fibers is dissolved away after made into fabrics by the treatment with a solvent, and do not disclose in any way a composite staple fiber having a surrounding that is not broken during the carding or needle punching process, but broken in the subsequent dividing and splitting process such as water jet treatment, etc. to cause the composite staple fibers to be subdivided into ultrafine fibers.

In addition, in the technique described in Japanese Patent Application Laid-Open No. 4-308224, since ultrafine fibers are formed by dissolving away the surrounding made of one of the components that encapsulates the other component, the yield of ultrafine fibers is low, resulting in the problem of poor production efficiency of ultrafine fibers. In addition, it is difficult to control the surrounding thickness to a desired level simply by changing the proportion of both components. The proposed technique is adequate for forming ultrafine fibers by entirely dissolving away one of the components with solvent, etc. However, not suitable for allowing both the components to remain as ultrafine fibers by a mechanical processing method, because the surrounding of the proposed technique is excessively thick thereby preventing the composite fibers from being split adequately.

Japanese Patent Application Laid-Open No. 5-44127 discloses composite long fibers for constituting composite pre-twisted yarns, and proposes a technique for inhibiting the fibrillation of composite fibers due to friction during a pre-twisting process by covering with polyester the surface of the composites long fibers having a polyamide-polyester layered structure. However, it is only described that, after making the composite pre-twisted yarn into a woven or knitted fabric, the covering polyester is dissolved away by alkali treatment, thereby dividing the composite components. Thus, there is no description of a composite staple fiber which is resistant to the peeling during the carding and the needle punching treatment of a non-woven fabric production, etc., but is subdivided into ultrafine fibers by the subsequent mechanical peeling and dividing process such as water jet treatment.

DISCLOSURE OF THE INVENTION

An object of the present invention is to provide a composite staple fiber and a production method thereof, in which there is substantially no occurrence of the peeling or splitting between the components that compose the composite fiber during the carding process, the needle punching process, etc., in the production of non-woven fabrics, etc., but the peeling and splitting between the composite components occur only in a subsequent physical dividing process such as a water jet treatment. Another object of the present invention is to provide a fiber structure that contains the above composite staple fiber and shows a superior wiping performance when used as a wiper. Still another object is to provide a fiber structure that contains the above composite staple fiber and exhibit a satisfactory texture and satisfactory color development when used as artificial leather.

Namely, in a first aspect of the present invention, there is provided a composite staple fiber having a layered composite structure in which a polymer component A and a polymer component B are alternately arranged in a fiber cross-section, wherein the polymer component B is completely covered with the polymer component A, the polymer component B and a portion of the polymer component A except for the skin-forming portion has a substantially flat shape, and in the fiber cross-section, the ends of the polymer component B in the lengthwise direction are located 0.05 to 1.5 $\mu$m inside the fiber surface, and a weight ratio of the polymer component A to the polymer component B is from 90/10 to 10/90.

In a second aspect of the present invention, there is provided a process for producing a composite staple fiber having a layered composite structure in which a polymer component A and a polymer component B are alternately arranged in a fiber cross-section, wherein the polymer component A and the polymer component B are melt-spun so that a solubility parameter, SP value, and a melt viscosity during the melt-spinning of each component satisfy the following Equation 1:

$$\eta_A-\eta_B \leqq -200\times(SP_A-SP_B) \quad 1$$

wherein $\eta_A$ is a melt viscosity (poise) of the polymer component A during the melt-spinning, $\eta_B$ is a melt viscosity (poise) of the polymer component B during the melt-spinning, $SP_A$ is a solubility parameter of the polymer component A, and $SP_B$ is a solubility parameter of polymer component B.

BEST MODE FOR CARRYING OUT THE INVENTION

Figure 1:
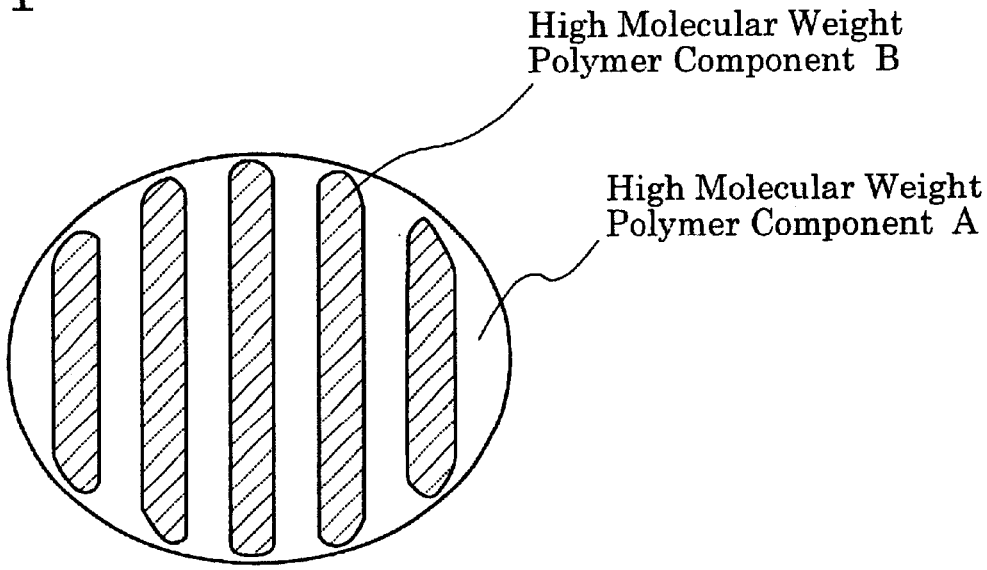
FIG. 1 is a cross-sectional view showing an example of the composite staple fiber of the present invention.

In the composite staple fiber of the present invention, as shown in FIG. 1, for example, it is important that the polymer component B be completely covered with the polymer component A which is present over the entire periphery in any of the fiber cross-section. In the case the component B is not entirely covered with the component A, in the carding or needle punching process in the production of a non-woven fabric, for example, the peeling and splitting in the lengthwise direction of the fiber occur at the interface between the composite components.

In order to form a surrounding near the fiber surface, it is necessary that the weight ratio of the component A to the component B be within the range of 90/10 to 10/90, and preferably 85/15 to 15/85. In the case the weight ratio of the component B is less than 10%, it becomes difficult to alternately arrange the component A and the component B in a spinning pack to form the target cross-section. In the case the weight ratio of the component B exceeds 90%, it is difficult to obtain the target cross-section owing to a small amount of the component A, and it also becomes difficult to cover the entire fiber surface or the surrounding thickness becomes excessively thin.

In addition, in the present invention, the component B and the component A except for the portion forming the skin of the composite staple fiber, i.e., the component A sandwiched between two layers of the component B, substantially exhibits a flat shape when viewing the fiber cross-section. Moreover, in the fiber cross-section, it is important that the lengthwise ends of the component B be located 0.05 to 1.5 $\mu$m, preferably 0.1 to 1.0 $\mu$m, from the fiber surface owing to the presence of the surrounding comprised of the component A.

In the case the thickness of the surrounding of the component A formed between the fiber surface and the component B is less than 0.05 $\mu$m, the surrounding is broken by abrasion in the carding and needle punching processes, thereby causing the component A and the component B to peel and split each other and having a detrimental effect on the processing soundness of the non-woven fabric production. On the other hand, if the thickness exceeds 1.5 $\mu$m, although the peeling and splitting in the carding and needle punching processes are adequately prevented, the splitting of the composite stable fiber into ultrafine fibers becomes difficult in the subsequent water jet entanglement, etc.

In the present invention, ultrafine fibers composed of the component A and ultrafine fibers composed of the component B are formed within a fiber structure such as non-woven fabric containing the composite staple fibers by subjecting the fiber structure to a splitting processing using a physical means such as water jet entanglement. In consideration of a performance as a wiper or a soft feeling and color development as an artificial leather, it is important that both the component A and the component B have a flat cross-section.

For example, when a high-quality artificial leather such as a raised artificial leather with suede or nubuck finish is produced using the composite staple fiber of the present invention, the thinner the single fibers, the better the hand feeling. Thus, it is preferable to use fibers thinner than 0.1 dtex, namely fibers having a diameter of less than about 3 $\mu$m. In other words, it is preferable that single fibers of the ultrafine flat fibers respectively composed of the component A and the component B prepared by dividing the composite staple fibers have a widthwise thickness D, indicated in FIGS. 2*a* and 2*b*, of 3 $\mu$m or less. If the thickness is greater than 3 $\mu$m, the hand feeling becomes poor.

Moreover, in the case of the artificial leather, it is important that the color development be satisfactory. In order to achieve this, it is preferable that the ratio (L/D: flatness) of the length L in the lengthwise direction to the thickness D in the widthwise direction of the flat ultrafine fibers shown in FIGS. 2*a* and 2*b* be 2 or more. In the case the ratio is less than 2, since the color development does not improve, dyeing must be performed using a large amount of dye to result in high dyeing costs.

Moreover, although the thinner the thickness D in the widthwise direction of the flat ultrafine fibers, the better the hand feeling, and a high flatness results in satisfactory color development by dyeing, an excessively small thickness D and an excessively small fiber fineness result in a poor color development. Therefore, it is preferable that the single fiber fineness of each flat ultrafine fiber be 0.02 dtex or more in order to ensure a good hand feeling and a satisfactory color development. Although there are no particular restrictions on the upper limit of the single fiber fineness as far as it is within the range that enables the exhibition of effects as ultrafine fibers, the upper limit is preferably 0.6 dtex or less.

Figure 2A:
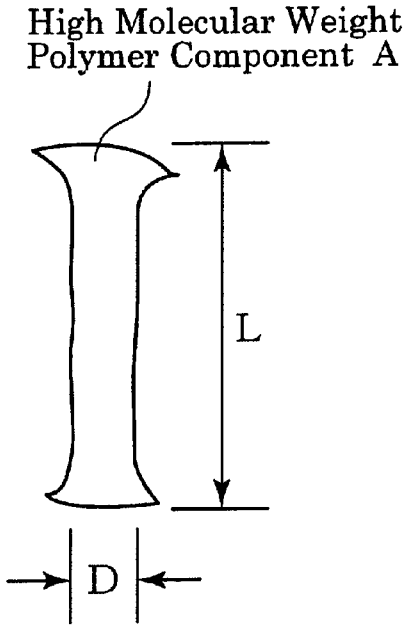
FIG. 2*a* is a cross-sectional view of a flat ultrafine fiber composed of a polymer component A, formed by dividing a composite staple fiber.
Figure 2B:
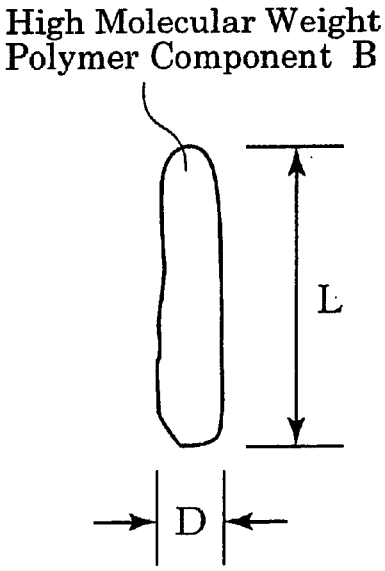
FIG. 2*b* is a cross-sectional view of a flat ultrafine fiber composed of a polymer component B, formed by dividing a composite staple fiber.

The dividing and splitting of the composite staple fiber of the present invention is mainly performed by a physical means such as a water jet treatment and a buffing treatment. The dividing and splitting occurs easily at the apex of both the roughly arc-shaped, lengthwise ends of the component B in the cross-section, namely the position where the surrounding of the component A is the thinnest. The cross-section of the component A formed as a result of the splitting has a shape of the letter "I" as shown in FIG. 2*a*, and two tapered projections extend from each lengthwise end in the direction roughly perpendicular (60–120°) to the lengthwise direction. These tapered projections are portions of the surrounding of the polymer A remaining after the splitting of the composite staple fiber.

In the present invention, these tapered projections function as sharp edges, and dirt, etc., can be easily removed by the sharp edges resulting in the favorable wiping capacity when the fiber structure is used as a wiper. In addition, the wiping capacity can be further improved because the dirt is directly captured in the gaps between the flat ultrafine fibers of the component A and the flat ultrafine fibers of the component B.

Next, the following provides a description of the production method of the composite staple fiber of the present invention.

In the present invention, in accordance with known methods, the polymer component A and the polymer component B are separately melted in respective melt extruders, introduced into a spinneret so that the component A and the component B are alternately arranged, and then discharged from the spinneret. Particularly, in a spinning pack, the ends of the component B facing the inner wall surface of the spinning pack become rounded because of its surface tension to form gaps between the component B and the inner wall surface, and as a result thereof, the component A flows into the gaps, thereby obtaining the composite staple fiber of the present invention in which the entire periphery of the fiber cross-section is covered with the component A.

To ensure that the ends of the component B become rounded as described above, the solubility parameters (SP values) of the components A and B in the spinning pack and their melt viscosities at the spinning temperature must satisfy the specific relationship indicated by Equation 1:

$$\eta_A-\eta_B \leqq -200\times(SP_A-SP_B) \quad 1$$

wherein $\eta_A$ is a melt viscosity (poise) of the component A during the melt-spinning, $\eta_B$ is a melt viscosity (poise) of the component B during the melt-spinning, $SP_A$ is a solubility parameter of the component A, and $SP_B$ is a solubility parameter of the component B.

The SP values of the component A and the component B in the present invention can be calculated according to the method proposed by P. A. J. Small, J. Appl. Chem., 3, 71(1953).

Generally, the ends of a polymer become rounded more easily by its surface tension with increasing SP value, because the polar groups of the polymer are positioned as far away from each other as possible. Accordingly, a higher SP value for the component B than that of the component A results in greater rounding of the ends of the component B. This allows the component A to flow easily into the gaps between the component B and the inner wall surface of the spinneret, and to cover the entire periphery of the fiber cross-section, making it easier to form a surrounding. However, even if the SP value of the component B is higher than that of the component A, in the case the melt viscosity of the component A at the spinning temperature is excessively higher than that of the component B, the effect of melt viscosity overcomes the effect of the SP value, causing the ends of the component A to become easily rounded and making it difficult to form the surrounding. Therefore, even in the case the SP value of the component B is higher than that of the component A, it is important that the difference between the melt viscosity of the component A and that of the component B does not exceed 200 times the difference in the SP values.

In addition, since a melt viscosity for the component B higher than that of the component A during the spinning process results in easier rounding of the ends of the component B, the component A flows easily into the gaps between the component B and the inner wall surface of the spinneret, and a surrounding is easily formed that covers the entire periphery of the fiber cross-section. However, even if the melt viscosity of the component B is higher than that of the component A, in the case the SP value of the component A during the spinning process is excessively higher than that of the component B, the effects of the SP value overcome the effects of the melt viscosity causing the ends of the component A to be easily rounded and making it difficult to form the surrounding. Thus, in the case the SP value of the component A is higher than that of the component B, it is important that the melt viscosity of the component B is larger than that of the component A by 200 times the difference in SP values or more.

As has been described above, the ends of the component B can be rounded and the component A can be made to flow into the gaps between the ends of the component B and the inner wall surface of the spinneret by setting the SP value balance or the melt viscosity balance of the component A and the component B so as to satisfy the specific conditions. In the present invention, the time taken from the alternate arrangement of the melt components A and B in the spinning pack until the arranged components are discharged from the nozzle is preferred to be longer. Namely, if the time until discharged is long, the component A goes easily around the component B to facilitate the formation of the surrounding by the shearing effects due to the contact with the wall surface of the nozzle during the components A and B dwell in the spinning pack. More specifically, the time is preferably 1.5 to 8 times longer, more preferably 2 to 5 times longer than the time generally required in using a spinning pack having a structure for ordinary spinning. In the case the time is less than 1.5 times longer, it is difficult to obtain the shearing effects, thereby preventing the formation of the surrounding. In the case the time exceeds 8 times longer, the retention time inside the spinning pack becomes excessively long and the polymers A and B undergo thermal degradation, resulting in the occurrence of breakage during the spinning and having a detrimental effect on the processing soundness.

After being discharged from the spinneret, the composite staple fiber of the present invention can be obtained by following the processes such as drawing, crimping, drying and cutting in accordance with known production techniques for composite spun fibers.

The components A and B that constitute the composite staple fiber of the present invention and the combination thereof can be arbitrarily selected according to their application and required performance in consideration of the SP value balance and the melt viscosity balance. In preferable combinations of the component A and the component B, the difference in their SP values is 1 or more. In the case the difference in SP values is less than 1, adhesion at adjoining surfaces increases because of the high compatibility between the polymers. Although this is advantageous for the processing soundness of the carding process and the needle punching process, it makes the subsequent dividing and splitting of the composite staple fibers difficult.

In consideration of this point, the components A and B can be selected from the following polymers according to their purpose and application: polyesters such as polyethylene terephthalate-based polymer and polybutylene terephthalate-based polymer, polyolefins such as polyethylene and polypropylene, polyamides such as Nylon 6 and Nylon 66, styrene-based polymers, vinyl alcohol-based polymers and ethylene-vinyl alcohol-based copolymers. These polymers may be used alone or in combination of two or more as each polymer component.

Polyethylene terephthalate-based polymers and/or polybutylene terephthalate-based polymers may include one or more other dicarboxylic acid components, oxycarboxylic acid components or diol components as the copolymerized unit, if necessary. Examples of other dicarboxylic acids include aromatic dicarboxylic acids such as diphenyldicarboxylic acid and naphthalene dicarboxylic acid; ester-forming derivatives of the aromatic dicarboxylic acids; metal sulfonate group-containing aromatic carboxylic acid derivatives such as dimethyl 5-sodiumsulfoisophthalate and bis(2-hydroxyethyl) 5-sodiumsulfoisophthalate; aliphatic dicarboxylic acids such as oxalic acid, adipic acid, sebacic acid and dodecanedioic acid; and ester-forming derivatives of the aliphatic dicarboxylic acids. Examples of the oxycarboxylic acid components include p-oxybenzoic acid, p-β-oxyethoxybenzoic acid and their ester-forming derivatives. Examples of the diol components include aliphatic diols such as diethylene glycol, 1,3-propanediol, 1,6-hexanediol and neopentyl glycol; 1,4-bis(β-oxyethoxy)benzene; polyethylene glycol; and polybutylene glycol.

In the present invention, the use of a polyester such as polyethylene terephthalate for the component A and a polyamide such as Nylon 6 for the component B, each satisfying the above Equation 1 for the SP value balance and the melt viscosity balance, is particularly preferable. Since the SP value of polyethylene terephthalate is generally 10.5 and the SP value of Nylon 6 is generally 13.5, Equation 1 is modified with these values as $\eta_A-\eta_B \leqq -200\times(10.5-13.5)=600$. Thus, the degrees of polymerization of the respective polymers and spinning conditions should be decided so that the difference in melt viscosities of both polymers during the spinning operation satisfies this equation. For example, a suitable combination may be selected from polyethylene terephthalate having an intrinsic viscosity [η] of 0.5 to 0.8 dl/g (measured in a 1:1 mixture of phenol and 1,1,2,2-tetrachloroethane at 30° C.) and a spinning temperature of 275 to 310° C., or Nylon 6 having a relative viscosity of 1.5 to 4.0 with respect to 96% sulfuric acid (measured at 25° C. in a concentration of 1 g/100 ml) and a spinning temperature of 235 to 300° C.

The composite form shown by the cross-section of the composite staple fiber of the present invention may be a multilayer form, hollow multilayer form, a petal form, or a hollow petal form according to the intended application and performance. In the applications as wiper and artificial leather, preferred is the multilayer form in which the layers of the component A and the layers of the component B are alternately layered. In addition, the fiber is not limited to a circular cross-section fiber, but may be a modified cross-section fiber.

There are no particular restrictions on the single fiber fineness of the composite staple fiber, and it can be arbitrarily selected according to the particular application over a range of, for example, 0.5 to 30 dtex. In addition, the cut length may also be arbitrarily selected over a range of 1 mm to 20 cm according to the application.

Moreover, the composite staple fiber of the present invention may be incorporated with various additives, if necessary. Examples of additives include catalyst, coloring preventive, heat-resistance improver, flame retardant, fluorescent whitener, delustering agent, colorant, lustering improver, antistatic agent, fragrance, deodorizer, bactericide, miticide, and inorganic fine particles. In addition, the additives may be blended into either or both of the components A and B.

Next, the following provides an explanation of the production method of the fiber structure that contains the composite staple fibers of the present invention. Basically, the fiber structure may be produced by various suitable production methods according to the physical properties required for each application. For example, a fiber structure can be obtained by carding a raw stock comprising 20 wt % or more of composite staple fibers and other fibers to prepare a web which is then subjected to water jet treatment thereby splitting and entangling the composite staple fibers. Alternatively, a fiber structure can be obtained by carding a raw stock containing 20 wt % or more of composite staple fibers to prepare a web which is then entangled by a needle punching treatment, followed by a splitting treatment by a physical method such as a buffing treatment.

In addition, a fiber structure can be obtained by making a raw stuff containing 20 wt % or more of the composite staple fibers into a fibrous sheet form which is then subjected to a splitting and entangling treatment by a water jet. Alternatively, a fiber structure can be obtained by entangling the fibrous sheet form by needle punching and then splitting by a physical method such as buffing. In addition, a fiber structure can also be produced by using a raw stuff containing 20 wt % or more of the composite staple fibers split in advance by a physical method.

In the case the composite staple fiber content of the fiber structure is less than 20 wt %, it is difficult to obtain the effects produced by the sharp edge of the flat ultrafine fibers of the component A. Therefore, for example, the wiping performance of a wiper becomes poor, and a sheet-form structure fail to give a luster due to the flat cross-sections.

Fibers usable in combination with the composite staple fiber of the present invention may be selected from synthetic fibers such as polyester fiber, Nylon fiber, acrylic fiber, polyvinyl alcohol fiber, polyethylene fiber, polypropylene fiber, and vinyl chloride fiber, or natural fibers such as pulp, cotton, and hemp. Two or more of these fibers may be used.

In the present invention, the fiber structure containing the composite staple fibers may be layered to or entangled with another fiber structure such as knitted fabric or woven fabric. In addition, the composite staple fibers can be split by subjecting a fiber structure to a physical processing after having been entangled.

Although the present invention exhibits its maximum effect in the case of using water jet entanglement or buffing treatment as the methods for dividing and splitting the composite staple fibers, the dividing and splitting may be performed by an alkali reduction treatment when the component A is polyester.

The above fiber structure can be used in various applications. For example, as-produced fiber structure or a fiber structure impregnated with various resins is used as a wiper.

The fiber structure can also be formed into artificial leather by a suitable method in accordance with its intended use. For example, after preparing a fiber structure by performing the carding process and needle punching process, and then splitting the composite staple fibers by a chemical method such as alkali reduction using an aqueous sodium hydroxide, polyurethane resin is impregnated into the resulting fiber structure, followed by dyeing the surface to obtain artificial leather.

The following provides a detailed explanation of the present invention through its examples. However, the present invention is not limited in any way by the examples.

In the following examples, shown are the combination of the polymers constituting the composite staple fibers, the thickness of the surrounding formed thereon, the flatness L/D wherein D is the thickness and L is the length of the flat ultrafine fibers of its cross-section, the card processing soundness of the composite staple fiber, the needle punching processing soundness, the ability of splitting by water jet entanglement, the hand feeling of the base fabric for artificial leather, and the color development by dyeing. In addition, the wiping capability of the web made of the composite staple fibers was evaluated. In addition, the intrinsic viscosity [η] of polyester was measured at 30° C. in a 1:1 solvent of phenol and 1,1,2,2-tetrachloroethane, and the relative viscosity of Nylon was measured at 25° C. in a concentration of 1 g/100 ml in 96% sulfuric acid.

The surrounding thickness, the flatness L/D, the card processing soundness, the needle punching processing soundness, the ability of splitting by water jet entanglement, the color development by dyeing, and the wiping capability were measured or evaluated by the following methods.

Surrounding Thickness of Composite Staple Fiber

A test fiber was immersed in a hot water bath at 100° C. for 10 minutes with both ends thereof fixed under tension, thereby causing a crack in the interface between the component A and the component B by the shrinkage difference. Then, the cross section of the resultant fiber was observed under a scanning electron microscope to measure the surrounding thickness.

Flatness L/D

The cross section of the same sample fiber after cracking as used in the above was observed under a scanning electron microscope. In the cross section, the thickness D and the length L of the flat ultrafine fiber of each of the components A and B were measured. The flatness L/D was calculated from the obtained results.

Single Fiber Fineness of Flat Ultrafine Fibers

The fineness was calculated by multiplying the cross-sectional area (D×L) and the density of each polymer component.

Processing Soundness of Card Treatment

A web was prepared by passing the composite staple fibers through a miniature carding machine so as to achieve a basis weight of 50 g/m$^2$, followed by observation of the presence or absence of neps and the lateral surfaces of the fibers under an optical microscope.

Processing Soundness of Needle Punching Treatment

A web having a basis weight of 180 g/m$^2$ was prepared through the carding and cross-wrapping processes. After needle-punching the web at 1000 needles per cm$^2$, the inside of the web was observed under a scanning electron microscope to determine whether the peeling and splitting of the composite staple fibers occurred.

Water Jet Entanglement

A web having a basis weight of 50 g/m$^2$ was prepared by through the carding treatment. After performing the water jet treatment at a water pressure of 30 to 60 kg/cm$^2$, the web was observed under a scanning electron microscope to examine the occurrence of the peeling and splitting of the composite staple fiber.

Color Development by Dyeing

The surface of the web after the needle punching treatment was buffed to split the fibers, followed by dyeing under the following conditions. The Kubelka-Munk K/S value was determined from the reflectance of the web, and on the basis of the results, the color development was ranked by the following four grades.

Dyeing Conditions:

1. Presetting: 170° C.
2. Dispersion dyeing: treated for 40 minutes at 125° C. using a dispersion dye (CI Disperse Red 183)
3. Relaxation treatment: treated for 20 minutes at 85° C.
4. Acid dyeing: treated for 40 minutes at 98° C. using an acid dye (CI Acid Red 215)
5. Soaping: treated for 20 minutes at 70° C. using Amyradin D (Daiichi Kogyo Seiyaku Co., Ltd.)
6. Final setting: 160° C.

Grades of Color Development:

A: Extremely good (K/S value: greater than 16)
B: Good (K/S value: 14–16)
C: Fair (K/S value: 12–14)
D: Poor (K/S value: less than 12)

Hand Feeling

The hand feeling of the base fabric dyed according to the above method was ranked by the following four grades.

A: Extremely soft and smooth
B: Soft and smooth
C: Somewhat hard
D: Hard and rough Wiping Capability A circle of 2 cm in diameter was drawn with commercially available India ink on a glass plate and allowed to dry. After drying, a 5×5 cm sample web was placed on the ink circle, and a 500 g weight was additionally placed on the sample web. The web loaded with the weight was moved back and forth over the glass plate at a fixed speed, and the ink circle drawn on the glass was investigated to determined after how many cycles the circle disappeared.

EXAMPLE 1

Polyethylene terephthalate (SP value=10.5, [η]=0.58 dl/g) for the polymer component A and Nylon 6 (SP value 32 13.5, relative viscosity=2.45) for the polymer component B were alternately arranged into eleven layers at a weight ratio (former/latter) of 75/25, and the arranged components were spun by discharging from a nozzle at 285° C. The apparent relative viscosities during spinning were 1000 poise and 1200 poise, respectively. After spinning, the as-spun fiber was drawn, crimped mechanically and then cut to a length of 51 μm to obtain composite staple fibers having the cross-sectional shape as shown in FIG. 1. The single fiber fineness of the resulting composite staple fibers was 3.3 dtex, and the mean thickness of the surrounding of the component A that covered the fiber periphery was 0.5 μm when measured at five cross-sections cut at 5 mm intervals. A web composed of ultrafine fibers was prepared using the composite staple fibers through the carding treatment and the water jet entanglement. Although the fiber splitting was not observed after the carding treatment, the fibers were split by the subsequent water jet entanglement.

The observation of the cross-section of the resulting ultrafine fibers under a scanning electron microscope showed that the ultrafine fibers composed of the component A had an I-shaped cross-section, and the tapered projections extended from both the lengthwise ends in a direction nearly perpendicular to the lengthwise direction.

The dirt wiping capability of this web were better than that of a wiper made of round cross-sectional fibers known in the art.

Another web was prepared from the composite staple fibers by sequential treatments of carding, cross-wrapping, and needle punching. There were no problems in the web production, and the processing soundness was favorable in any of the processes. In addition, no fiber splitting was noticed by the observation of the inside of the web under a scanning electron microscope.

COMPARATIVE EXAMPLE 1

With the exception of changing the weight ratio of the component A and the component B to 5/95, fibers were formed in the same manner as in Example 1. However, the surrounding of the component A was not formed on the periphery of the fibers, thereby making it unsatisfactory. A web was prepared from the resultant composite staple fibers through the carding treatment and the water jet treatment. Another web was prepared through the carding, cross-wrapping, and needle punching processes. In both the cases, neps occurred in the carding process, thereby preventing the production of webs which were suitable for practical use. In addition, the inside observation of the webs by a scanning electron microscope showed that the substantial part of the fibers were split.

COMPARATIVE EXAMPLE 2

With the exception of changing the weight ratio of the component A and the component B to 95/5, fibers were formed in the same manner as in Example 1. However, the cross-sectional observation of the composite staple fibers revealed that the components failed to be arranged into eleven layers, thereby preventing the target fibers from being obtained.

COMPARATIVE EXAMPLE 3

Polyethylene terephthalate (SP value=10.5, [η]=0.55 dl/g) for the polymer component A and Nylon 6 (SP value=13.5, relative viscosity=3.00) for the polymer component B were alternately arranged into eleven layers at a weight ratio (former/latter) of 90/10, and the arranged components were spun by discharging from a nozzle at 285° C. The apparent relative viscosities during spinning were 500 poise and 2000 poise, respectively. After spinning, the as-spun fiber was drawn, crimped mechanically and then cut to a length of 51 μm. The single fiber fineness of the resulting composite staple fibers was 3.3 dtex, and the mean thickness of the surrounding of the component A that covered the fiber periphery was 2.1 μm when measured at five cross-sections cut at 5 mm intervals.

A web was prepared using the composite staple fibers through the carding treatment and the water jet entanglement. The fiber splitting was not observed after the carding treatment. Although entangled in the subsequent water jet treatment, the fiber splitting did not occur because of the thick surrounding of the component A, thereby failing to obtain a target web composed of ultrafine fibers. In addition, there were no difference in the wiping capability between the web prepared above and the web made of a round cross-sectional fibers known in the art.

EXAMPLES 2–6 AND COMPARATIVE EXAMPLES 4–6

As shown in Table 1, with the exception of changing the weight ratios of the components (A) and (B), the combination of SP values, and the combination of melt viscosities, respective multi-layered composite staple fibers of 11 layers were obtained in the same manner as in Example 1. Respective webs were then formed in the same manner as in Example 1 using the resulting composite staple fibers. The thickness of the surrounding of the component A of each composite staple fiber and the results of the carding, needle punching, and water jet entangling treatments of each web are shown in Table 1.

The cross-sectional observation by a scanning electron microscope on the fibers after the fiber splitting showed that the ultrafine fibers of the component A of the present invention had unique cross-sectional shapes having projections similar to Example 1.

TABLE 1

| | Examples | | | | | |
|---|---|---|---|---|---|---|
| | 1 | 2 | 3 | 4 | 5 | 6 |
| Component A | PET | PET | PET | PET | PET | NY6 |
| (wt %) | (75) | (67) | (90) | (20) | (67) | (67) |
| Component B | NY6 | NY6 | NY6 | NY6 | NY6 | PET |
| (wt %) | (25) | (33) | (10) | (80) | (33) | (33) |
| Fineness (dtex) | 3.3 | 3.3 | 3.3 | 3.3 | 3.3 | 3.3 |
| SP Value | | | | | | |
| Component A | 10.5 | 10.5 | 10.5 | 10.5 | 10.5 | 13.5 |
| Component B | 13.5 | 13.5 | 13.5 | 13.5 | 13.5 | 10.5 |
| Melt Viscosity (P) | | | | | | |
| Component A | 1000 | 1000 | 1000 | 1000 | 1000 | 1000 |
| Component B | 1200 | 1200 | 1200 | 1200 | 800 | 2000 |
| Surrounding Thickness (μm) | 0.5 | 0.4 | 1.5 | 0.1 | 0.3 | 0.3 |
| Fiber Thickness (D) (μm) | | | | | | |
| Component A | 2.4 | 2.2 | 2.4 | 0.5 | 2.1 | 2.7 |
| Component B | 1.2 | 1.6 | 0.4 | 2.9 | 1.5 | 1.3 |
| Flatness (L/D) | | | | | | |
| Component A | 5.0 | 5.5 | 6.3 | 32 | 6.2 | 4.4 |
| Component B | 10 | 7.5 | 38 | 5.5 | 8.7 | 9.2 |
| Fineness (dtex) | | | | | | |
| Component A | 0.41 | 0.37 | 0.50 | 0.11 | 0.37 | 0.37 |
| Component B | 0.17 | 0.22 | 0.07 | 0.53 | 0.22 | 0.22 |
| Processing Soundness | | | | | | |
| Carding | no* | no* | no* | no* | no* | no* |
| Needle Punching | no* | no* | no* | no* | no* | no* |
| Water Jet Entanglement | yes* | yes* | yes* | yes* | yes* | yes* |

| | Comparative Examples | | | | | |
|---|---|---|---|---|---|---|
| | 1 | 2 | 3 | 4 | 5 | 6 |
| Component | PET | PET | PET | PET | NY6 | NY6 |
| (wt %) | (5) | (95) | (90) | (67) | (67) | (67) |
| Component B | NY6 | NY6 | NY6 | NY6 | PET | PET |
| (wt %) | (95) | (5) | (10) | (33) | (33) | (33) |
| Fineness (dtex) | 3.3 | 3.3 | 3.3 | 3.3 | 3.3 | 3.3 |

TABLE 1-continued

| | | | | | | |
|---|---|---|---|---|---|---|
| SP Value | | | | | | |
| Component A | 10.5 | 10.5 | 10.5 | 10.5 | 13.5 | 13.5 |
| Component B | 13.5 | 13.5 | 13.5 | 13.5 | 10.5 | 10.5 |
| Melt Viscosity (P) | | | | | | |
| Component A | 1000 | 1000 | 500 | 2000 | 1200 | 2000 |
| Component B | 1200 | 1200 | 2000 | 1200 | 800 | 1000 |
| Surrounding Thickness (μm) | nc* | — | 2.1 | nc* | nc* | nc* |
| Fiber Thickness (D) (μm) | | | | | | |
| Component A | 0.1 | — | 2.4 | 2.1 | 2.7 | 2.7 |
| Component B | 3.5 | — | 0.4 | 1.5 | 1.3 | 1.3 |
| Flatness (L/D) | | | | | | |
| Component A | 160 | — | 6.3 | 6.2 | 4.4 | 4.4 |
| Component B | 4.5 | — | 38 | 8.7 | 9.2 | 9.2 |
| Fineness (dtex) | | | | | | |
| Component A | 0.03 | — | 0.50 | 0.37 | 0.37 | 0.37 |
| Component B | 0.63 | — | 0.07 | 0.22 | 0.22 | 0.22 |
| Processing Soundness | | | | | | |
| Carding | im* | — | no* | im* | im* | im* |
| Needle Punching | im* | — | no* | im* | im* | im* |
| Water Jet Entanglement | — | — | no* | — | — | — |

no*: no fiber splitting
yes: fiber splitting occurred
nc*: failed to form a surrounding
im*: processing was impossible
No 11-layered laminate structure was attained in Comparative Example 2.

EXAMPLES 7–8 and COMPARATIVE EXAMPLE 7

After mixing the composite staple fibers obtained in Example 2 with 1.1 dtex, 51 mm polyethylene terephthalate fibers having a circular cross-section at a weight ratio of 50/50 (Example 7), 20/80 (Example 8) or 15/85 (Comparative Example 7), each mixture was subjected to the carding treatment and the water jet entanglement to obtain a web having a basis weight of 50 g/m$^2$. The wiping capacity of the web was then evaluated. Although the wiping capacity was satisfactory in Examples 7 and 8, inadequate in Comparative Example 7.

COMPARATIVE EXAMPLE 8

After carding 2.2 dtex, 51 mm raw polyethylene terephthalate fibers having a circular cross-section, the water jet entanglement was performed to obtain a web having a basis weight of 50 g/m$^2$. The wiping capability of the resultant web was inadequate.

COMPARATIVE EXAMPLE 9

After carding 1.1 dtex, 51 mm raw polyethylene terephthalate fibers having a circular cross-section, the water jet entanglement was performed to obtain a web having a basis weight of 50 g/m$^2$. The wiping capacity of the resultant web was inadequate.

<Evaluation>

The water-jet entangled webs obtained in Examples 1, 2, 7 and 8 and Comparative Examples 7–9 were evaluated on the wiping capacity as a wiper and the performance as a base fabric for artificial leather. The results are shown in Table 2.

TABLE 2

| | Examples | | | | Comparative Examples | | |
|---|---|---|---|---|---|---|---|
| | 1 | 2 | 7 | 8 | 7 | 8 | 9 |
| Composite staple fiber (wt %) | 100 | 100 | 50 | 20 | 15 | 0 | 0 |
| PET fiber (wt %) | 0 | 0 | 50 | 80 | 85 | 100 | 100 |
| Number of cycles required for disappearance | 2 | 2 | 3 | 3 | 5 | 8 | 6 |
| Wiping capability | A | A | B | B | C | D | D |
| Hand feeling | A | A | B | B | C | D | D |
| Color development | A | A | A | A | A | A | A |

Industrial Applicability

The present invention provides a composite staple fiber having its periphery covered with a polymer component A, which is resistant to the fiber splitting in the carding and needle punching processes in the non-woven fabric production, but subject to the fiber splitting only by a subsequent physical treatment such as a water jet entanglement. The flat ultrafine fibers obtained by splitting the composite staple fiber exhibit satisfactory wiping performance as a result of the sharp edge structure, and provide a base cloth for artificial leather having excellent hand feeling and color development as a result of the specific flat structure.

What is claimed is:

1. A composite staple fiber having a layered composite structure in which a polymer component A and a polymer component B are alternately arranged in a fiber cross-section, wherein the polymer component B is completely covered with the polymer component A;

the polymer component B and a portion of the polymer component A except for the skin-forming portion has a substantially flat shape, and in the fiber cross-section, the ends of the polymer component B in the lengthwise direction are located 0.05 to 1.5 μm inside the fiber surface; and a weight ratio of the polymer component A to the polymer component B is from 90/10 to 10/90.

2. The composite staple fiber according to claim 1, wherein a thickness D in the widthwise direction of each of the polymer component A and the polymer component B in the fiber cross-section is 3 μm or less, and a ratio (L/D) of a length L in the lengthwise direction to the thickness D is 2 or more for each of the polymer components A and B.

3. The composite staple fiber according to claim 1 or claim 2, wherein the polymer component A is polyester, and the polymer component B is polyamide.

4. A process for producing a composite staple fiber having a layered composite structure in which a polymer component A and a polymer component B are alternately arranged in a fiber cross-section, wherein the polymer component A and the polymer component B are melt-spun so that a solubility parameter, SP value, and a melt viscosity during the melt-spinning of each component satisfy the following Equation 1:

$$\eta_A - \eta_B \leq -200 \times (SP_A - SP_B) \quad (1)$$

wherein $\eta_A$ is a melt viscosity (poise) of the polymer component A during the melt-spinning, $\eta_B$ is a melt viscosity (poise) of the polymer component B during the melt-spinning, $SP_A$ is a solubility parameter of the polymer component A, and $SP_B$ is a solubility parameter of the polymer component B.

5. A non-woven fiber structure containing 20 wt % or more of the composite staple fiber according to any one of claims 1 to 3, wherein the polymer component A and the polymer component B of the composite staple fiber is split at least a portion of the interface between them to form a ultrafine fiber of the polymer component A having a sharp-edged structure, and fibers that constitute the non-woven fabric are entangled.

6. The fiber structure according to claim 5, wherein the non-woven fiber structure is a dry non-woven fabric or a wet non-woven fabric.

7. The fiber structure according to claim 5 or 6, which is entangled with a woven fabric or a knitted fabric into a single structure.

8. The fiber structure according to any one of claims 4 to 7, for use as a wiper.

9. The fiber structure according to any one of claims 4 to 7, for use a base fabric for artificial leather.

* * * * *